United States Patent [19]

Cross et al.

[11] Patent Number: 4,945,586

[45] Date of Patent: Aug. 7, 1990

[54] CANOPY BED FRAME ASSEMBLY

[75] Inventors: Ramon Cross, Wilton, Conn.; Milton Markowitz, Flushing, N.Y.; Louis Selgrath, Mays Landing, N.J.

[73] Assignee: CHF Industries, New York, N.Y.

[21] Appl. No.: 399,223

[22] Filed: Aug. 25, 1989

[51] Int. Cl.[5] ..... A47C 29/00

[52] U.S. Cl. ..... 5/414; 135/90

[58] Field of Search ..... 5/414, 512; 135/90, 135/96, 101, 902

[56] References Cited

U.S. PATENT DOCUMENTS

| | | | |
|---|---|---|---|
| D. 249,915 | 10/1978 | Vargas . | |
| 364,415 | 6/1887 | Hooper . | |
| 785,571 | 3/1905 | Raines et al. . | |
| 875,206 | 12/1902 | Osborne . | |
| 929,035 | 7/1909 | Skinner | 5/414 X |
| 3,237,217 | 3/1966 | Desneux . | |
| 3,956,784 | 5/1976 | Vargas . | |
| 4,414,727 | 11/1983 | Steele . | |
| 4,729,137 | 3/1988 | Denney . | |
| 4,779,294 | 10/1988 | Miller . | |
| 4,782,541 | 11/1988 | Tuchman . | |

FOREIGN PATENT DOCUMENTS

| | | | |
|---|---|---|---|
| 899673 | 6/1962 | United Kingdom | 5/414 |

OTHER PUBLICATIONS

Dakotah Flat Top Canopy Frame Instructions (1982–1983).

*Primary Examiner*—Michael F. Trettel

*Attorney, Agent, or Firm*—Lockwood, Alex, FitzGibbon & Cummings

[57] ABSTRACT

A canopy bed frame assembly includes upper and lower horizontal frame members which are interconnected to vertical posts to form a frame structure. A canopy covering is supported by a continuous valance rod which encloses the upper frame members and is spaced apart therefrom. The canopy covering includes canopy cover panels and canopy valance panels which, when fitted onto the valance rod, substantially conceal the canopy frame structure from view.

8 Claims, 1 Drawing Sheet

CANOPY BED FRAME ASSEMBLY

BACKGROUND AND SUMMARY OF THE INVENTION

This invention relates to canopy beds and more specifically to a canopy bed frame assembly which converts an existing bed into a free-standing canopy bed in which the canopy frame completely encloses the bed and in which the canopy frame is substantially concealed from view.

Canopy beds have been widely used to add ambiance and style to a bedroom. Although popular and attractive in appearance, conventional canopy beds are usually bulky, cumbersome and expensive. Typically, the canopy bed structure is an integral part of the original bed frame. However, separate canopy structures which are separate from the bed frame but rigidly attached to the ceiling can provide somewhat the same effect as an integral canopy bed frame. The separate ceiling attachment is of relatively large weight and require complex hardware for such ceiling attachment. Once the canopy upper frame is attached to the ceiling, the bed is fixed in place within the bedroom and not readily movable.

The present invention is directed to a construction which avoids the aforementioned shortcomings.

In a canopy bed frame assembly incorporating the principles of the present invention, assembly of canopy bed frames may be accomplished without the need for installing the entire canopy or portion thereof into a room ceiling. Such a canopy bed assembly can be easily disassembled into its component parts for either cleaning or moving purposes. Additionally, the individual components of the canopy bed frame assembly can be inexpensively manufactured and can be easily modified to fit an existing bed.

In one principal aspect of the present invention, a canopy bed frame assembly includes a plurality of vertical posts which define the height of the canopy bed frame assembly, upper and lower frame members which are joined to the frame posts which define the upper and lower portions of the frame and a continuous canopy track extending around the upper frame perimeter.

In another aspect of the invention, a canopy valance support rod is spaced apart from the upper frame members by a series of generally S-shaped hooks which engage both the upper canopy frame and the valance support rod in an unobtrusive and concealed manner. A series of fabric sleeves which slidingly engage the vertical posts and upper frame members cooperate with a series of fabric cover panels and valance panels to substantially conceal the entire canopy frame from view.

Accordingly, it is a general object of the present invention to provide a new and improved canopy bed frame assembly to use in converting an existing bed into a free-standing canopy bed which canopy frame assembly is easily disassembled.

Another object of the present invention is to provide a kit of parts for use in assembling a free-standing canopy bed frame which, when fitted together, provide a canopy bed frame having upper and lower generally horizontal frame members joined to vertical posts. The upper frame members have a continuous canopy valance support rod disposed around the perimeter thereof. The valance support rod has a series of canopy covers and valance panels supported in sliding engagement.

A further object of the present invention is to provide a free-standing canopy bed having improved stability and having no attachments to the ceiling.

Yet another object of the present inventions is to provide a kit of parts for converting a bed into a free-standing canopy bed having vertical frame posts disposed at the corners of the bed and upper and lower frame members joining the posts to form the canopy frame. Fabric sleeves which are slid over the exposed portions of the vertical posts and upper frame members cooperate with a series of canopy corner and valance panels supported around the perimeter of the canopy upper frame to substantially conceal the canopy frame upper frame members and vertical posts from view.

These and other objects, features and advantages of the present invention will be clearly understood through a consideration of the following detailed description.

BRIEF DESCRIPTION OF THE DRAWINGS

In the course of this description, reference will be made to the attached drawings, in which.

DETAILED DESCRIPTION OF THE INVENTION

Figures 1, 2, 3, 4, 5, 6:
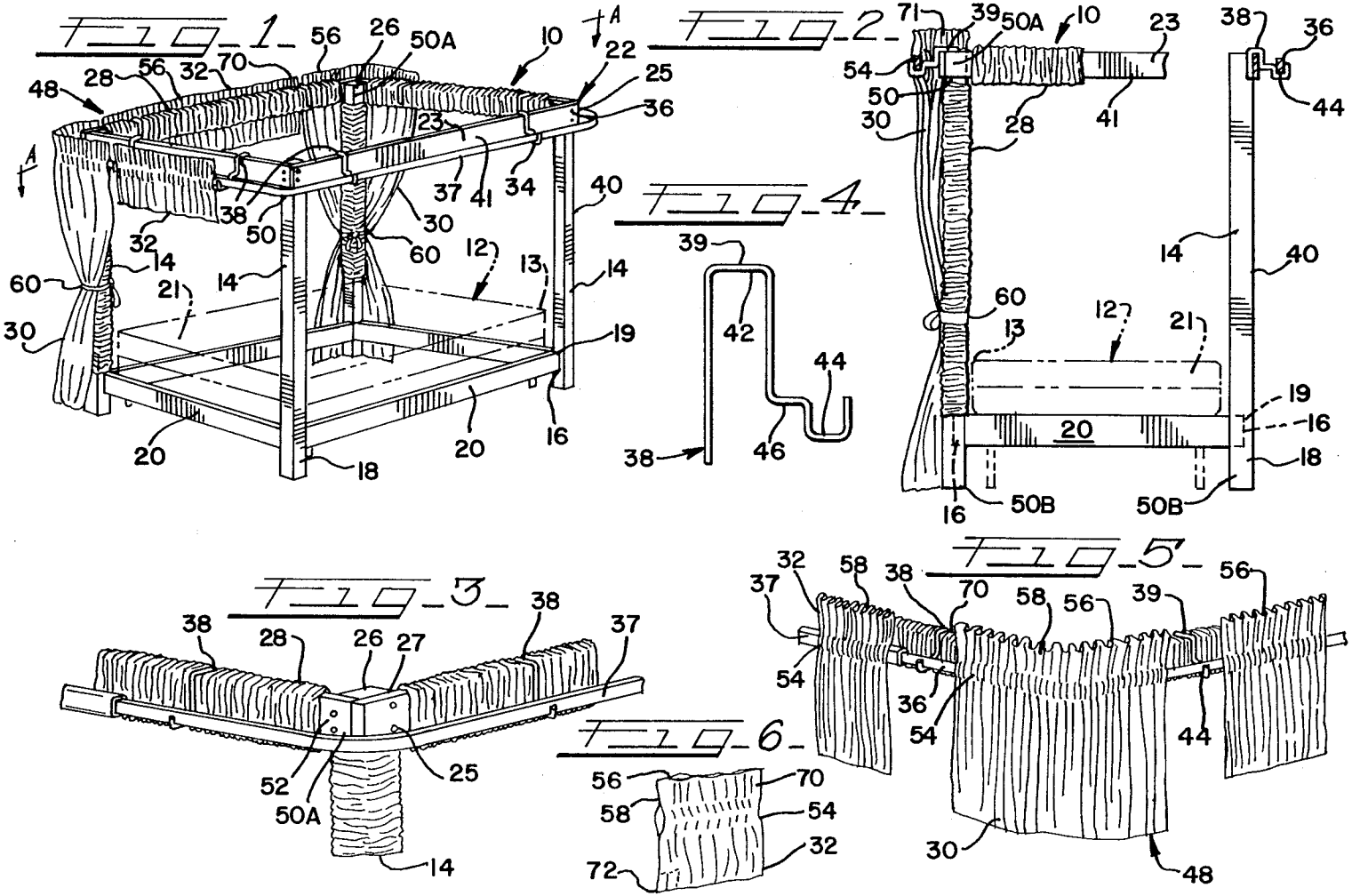
FIG. 1 is a perspective view of a free-standing canopy bed frame in accordance with the principles of the present invention with portions of the canopy corner and valance fabric panels removed along lines A—A to expose the frame structure.
FIG. 2 is a partially fragmented elevational end view of the canopy bed frame of FIG. 1 with one corner post removed and with portions of the canopy corner and valance panels removed for clarity.
FIG. 3 is an enlarged view of one corner of an upper frame of the canopy bed frame shown in FIG. 1 showing the placement of the fabric sleeves and valance rod support.
FIG. 4 is a plan view of a canopy valance rod attachment hook.
FIG. 5 is the corner view of FIG. 3 with the canopy corner and valance panels in place.
FIG. 6 is a view of a portion of the interior face of a canopy valance panel.

Referring now to FIG. 1, a canopy bed frame assembly 10 constructed in accordance with the principles of the present invention is shown disposed about a bed 12, illustrated in phantom.

As can be seen from the drawings, the canopy frame assembly 10 includes four vertical corner posts 14 which are disposed proximate to the corners 13 of the bed 12 and which posts define the outer dimensions of the canopy frame assembly 10. Each vertical post 14 has a recess 16 (FIG. 2) provided in its lower portion 18 to receive the ends 19 of the lower frame members 20 on the innermost portions thereof. When inserted into the recesses 16, the lower frame members 20 provide stability for the canopy frame assembly 10. The lower frame members 20 are aligned in the recesses 16 generally horizontally and are joined to the vertical posts 14 by any conventional means, such as wood screws. Preferably, the lower frame members 20 are positioned beneath the mattress 21 of the bed 12 so that they are covered in normal use by either the bed skirt or bed covering (not shown).

The vertical posts 14 support an upper frame 22 which is comprised of four elongated upper frame members 23 which are joined to the vertical posts 14 by any suitable means, such as wood screws 25. In order to substantially conceal the upper corner portions 26 of the posts 14 from view the upper frame members 23 are joined to the posts 14 on the outside face 27 thereof.

A series of elongated fabric sleeves 28 are provided and are dimensioned to slide over the upper frame members 23 and posts 14. These sleeves 28 fit over the entire extent of the posts 14 and upper frame members 23 and thus conceal the exposed portions 40, 41 of the posts 14 and upper frame members 23, respectively, from view. The fabric sleeves 28 are applied prior to joining the posts 14 and upper frame members 23. When those respective members are joined, the wood screws 25 are applied through the members' outer fabric sleeves 23.

In an important aspect of the invention, a series of canopy corner panels 30 and canopy valance panels 32 are positioned around the perimeter of the upper frame member 23 to completely encircle the canopy upper frame 22. Support means 34 for the canopy corner and valance panels 30, 32 are provided in the form of a continuous valance rod or track 36, illustrated as a curtain rod 37. The valance support rod 36 has a larger in its general perimeter than the perimeter of the canopy upper frame 22. The valance rod 36 is spaced apart from the upper frame members 23 and is supported therefrom by a series of hooks 38, (FIG. 4) all of which have a generally S-shaped configuration. The hooks 38 are preferably formed from a relatively thin, but sturdy wire. The hooks 38 have, at the opposite ends thereof, means for engaging the upper frame members 23 and the valance rods 36 in the form of generally rectangular channels 42, 44. The rectangular channels 42 are dimensioned so that they provide a snug fit over the upper frame members 23. Alternatively, the upper frame members 23 may have a generally circular cross-sectional configuration, in which instance, the channels 42 would be generally circular in configuration and a stop would be provided to prevent rotation of the hooks 38 on the upper frame members 23. The two channels 42 and 44 are separated by a hook spacer portion 46. This spacer portion 46, as best seen in FIGS. 1 and 2, spaces the valance rod 36 a preselected distance apart from the canopy upper frame 22. Preferably, the hooks 38 are positioned on the upper frame member 23 proximate to where the canopy corner and valance panels 30,32 meet.

Substantially all of the canopy bed frame structure is concealed from view by a canopy assembly 48. As described above, the elongated fabric sleeves 28 conceal the exposed interior portions 40,41 of the canopy frame 10. The vertical upper exposed exterior portions 50,52 of the canopy frame 10, namely, the upper and lower corners **50*a*, 50*b* of the vertical posts 14 and the outer face 52 of the upper frame members 23, are substantially concealed from view by fabric canopy corner panels 30 and fabric canopy valance panels 32 which are slid onto the continuous track 36**.

To accommodate the continuous valance track 36, both of the canopy corner panels 30 and canopy valance panels 32 are provided with a longitudinal sleeve 54 which in disposed proximate to the top 56 of the panels and extending the entire width thereof. The sleeves 54 are disposed in both the canopy panels 30,32 so that a short extension portion 58 of the panels projects above the panel sleeves 54. The extension portion 58 is of a sufficient length to extend above the top of the upper frame members 23 so as to substantially conceal the top of the upper frame members 23 from view.

On the opposite side of the panel sleeves 54, a panel canopy portion 60 extends a sufficient length below the sleeve to provide the proper canopy ambiance of the panels. In the case of the canopy valance panel 32, this length may be between 6 to 24 inches below the bottom of the upper frame members 23, whereas in the case of the canopy corner panels 30 this length will be substantially greater as shown in FIG. 1 where the corner panel 30 extends down to the floor. Canopy cover tiebacks 60 may be provided to tie the corner panels 30 to the vertical post 14 in their overlying relationship. Means for concealing the lower channels 44 of the support hooks 38 may be provided in the form of pockets 72 (not shown) disposed on the interior end portion 70 of either the canopy corner or valance panels 30,32 to conceal the hooks from view. Such pockets may also be provided on the interior face 71 of the panels.

The canopy frame structure 10 therefore can be easily adapted to rooms of various ceiling heights in that the vertical corner members can be trimmed to as to eliminate any interference between those members 16 and the room's ceiling. Moreover, for purposes of cleaning or altering the canopy covering assembly 48, the entire frame 10 need not be disassembled, rather the corner and valance panels 30,32 can be easily removed from the valance rod 36. To remove and clean the fabric sleeves 28, only the upper frame members need be removed.

Finally, it will be understood that the above description of the present invention is merely illustrative of a few applications of the principles of the invention. Numerous modifications may be made by those skilled in the art without departing from the true spirit and scope of the invention.

What we claim is :

1. A kit of parts for converting a bed into a free-standing canopy bed, the kit of parts comprising: a plurality of elongate vertical posts which define the corners of a canopy frame enclosing the bed, a plurality of elongate lower frame members connecting the vertical posts and defining a lower portion of the canopy frame, each of said vertical posts including a recess therein adapted to receive at least one of said lower frame members, said lower frame members providing stability to the canopy frame when connected to said vertical posts, a plurality of elongate upper frame members adapted for connection to said vertical posts, the upper frame members defining an upper portion of said canopy frame, continuous track means adapted to extend around the perimeter of said canopy frame upper frame portion, the continuous track means including a valance track spaced apart from said canopy frame upper frame members, means for supporting said continuous track means from said canopy frame upper frame members including a plurality of hooks, each of the hooks having an upper frame member engagement portion and a valance track engagement portion disposed at opposite ends thereof, the hook upper frame member engagement and valance track engagement portions being separated by a hook spacer portion of preselected length, means for covering said vertical posts and upper frame members and concealing said vertical posts and upper frame member from view including a plurality of fabric sleeves adapted to enclose said vertical posts and upper frame members, canopy valance means adapted to engage said continuous track means in a sliding relationship therein and canopy corner panel means adapted to engage said continuous track means in a sliding relationship thereon said canopy valance means substantially concealing said canopy frame upper frame members from view and further adapted to engage said canopy frame vertical posts in an overlying relationship.

2. The kit of parts of claim 1, wherein said canopy valance means include a plurality of elongate fabric valance panels of preselected width, each panel having a sleeve disposed therein extending the entire valance width of said panel, said sleeve being adapted to engage said continuous track means therein in said sliding relationship, each of said valance panels further having upper and lower valance extent portions disposed on opposite sides of said sleeve, said upper and lower valance extent portions having a preselected fabric extent sufficient to conceal said upper frame members from view.

3. The kit of parts of claim 2, wherein each of said fabric valance panels include a plurality of pockets adapted to engage said track supporting means hooks.

4. The kit of parts of claim 1, wherein said canopy corner panel means include a plurality of elongate fabric corner panels, each of the corner panels having a predetermined length sufficient to cover one of said vertical posts in said overlying relationship to substantially conceal said vertical post from view, each of said corner panels further including a corner panel sleeve disposed therein extending for the entire width of said panel, said corner panel sleeve defining a passage in said corner panel which is adapted to engage said continuous track means.

5. The kit of parts of claim 4, wherein each of said fabric corner panels include a plurality of pockets adapted to engage said track support means hooks.

6. The kit of parts of claim 1, wherein said supporting means hook upper frame member and valance track engagement portions define generally rectangular open channels.

7. A free-standing canopy bed frame assembly for enclosing a bed with a bed canopy, the canopy bed frame assembly comprising, in combination:

a plurality of vertical posts, the vertical posts defining the corners of said canopy bed frame;

a plurality of elongate lower frame members connecting the vertical posts, the lower frame members defining a lower portion of said canopy bed frame, said lower frame members being generally horizontally disposed between said vertical posts and operatively engaging said vertical posts in vertical post recess adapted to receive said lower frame members thereby providing stability to said canopy bed frame;

a plurality of elongate upper frame members operatively engaging said vertical posts and defining an upper portion of said canopy bed frame;

track means extending around the general perimeter of said canopy bed frame upper portion, said track means including a valance rod supported from and spaced apart from said canopy bed frame upper frame members;

means for supporting said track means from said upper frame members including a plurality of hooks having a generally S-shaped configuration, said hooks having upper frame member engagement channels at one end thereof and track means engagement channels at an opposite end thereof, the upper frame engagement channels and track means engagement channels being separated by a spacer portion disposed therebetween;

a plurality of fabric sleeves adapted to enclose said vertical posts and said upper frame members and substantially conceal portions of said vertical posts and said upper frame members from view;

a plurality of canopy valance panels adapted to engage said track means, the canopy valance panels including longitudinal sleeves adapted to engage said valance rod, said canopy valance panels further including upper and lower valance portions disposed on opposite sides of said sleeves, said upper and lower valance portions extending a preselected distance from said valance panel sleeves and having a length sufficient to conceal a face of said upper frame members from view, and a plurality of canopy corner panels adapted to engage said track means adapted to engage said vertical posts in an overlying relationship thereby substantially concealing said vertical posts from view, said canopy corner panels having a preselected length sufficient to overlie said vertical posts between said canopy frame upper and lower frame members, said canopy corner panels further including longitudinal sleeves adapted to engage said valance rod.

8. The free-standing canopy and frame assembly of claim 7 wherein either of said canopy corner panels or said canopy valance panels contain means for concealing said track engagement means channels in the form of pockets.

* * * * *